United States Patent [19]

Sanada et al.

[11] 4,195,608

[45] Apr. 1, 1980

[54] FUEL SUPPLY SYSTEM FOR ENGINES

[75] Inventors: Masakatsu Sanada; Toshimitsu Ito, both of Toyota; Masahiko Nakada, Okazaki, all of Japan

[73] Assignee: Toyota Jidosha Kogyo Kabushiki Kaisha, Japan

[21] Appl. No.: 807,525

[22] Filed: Jun. 17, 1977

[30] Foreign Application Priority Data

Mar. 22, 1977 [JP] Japan ..... 52/31358

[51] Int. Cl.[2] ..... F02M 37/20; F02M 5/10; F02M 15/00; F02M 19/06

[52] U.S. Cl. ..... 123/136

[58] Field of Search ..... 123/136

[56] References Cited

U.S. PATENT DOCUMENTS

| | | | |
|---|---|---|---|
| 2,963,013 | 12/1960 | Fisher | 123/136 |
| 3,026,862 | 3/1962 | Fisher | 123/136 |
| 3,628,516 | 12/1971 | Perrin | 123/136 |

*Primary Examiner*—Stephen C. Bentley
*Assistant Examiner*—Thomas H. Webb
*Attorney, Agent, or Firm*—Stevens, Davis, Miller & Mosher

[57] ABSTRACT

A fuel supply system for engines having a carburetor which has a float chamber and a vapor bleed passage connected to the float chamber, wherein a part of a fuel supply passage means for supplying fuel from a fuel tank to the carburetor traverses through the float chamber so that the fuel flowing through the fuel supply passage means absorbs heat from the fuel contained in the float chamber. The fuel entering into the float chamber releases volatile light components as vapor towards the vapor bleed passage while the liquid fuel contained in the float chamber becomes a more stable liquid due to the release of volatile components and the cooling effected by heat exchange with the fuel flowing through the fuel supply passage means.

7 Claims, 4 Drawing Figures

FUEL SUPPLY SYSTEM FOR ENGINES

BACKGROUND OF THE INVENTION

The present invention relates to a fuel supply system for engines and, more particularly, an improved fuel supply system for gasoline engines having a carburetor.

The gasoline engines for automobiles which incorporate an exhaust gas recombustion system such as a catalytic converter or a thermal reactor in order to meet the regulations with regard to engine emission generally cause a higher engine environment temperature which in turn is liable to cause an overheating of the fuel existing in the fuel supply system for the engine including the carburetor. If the temperature of the fuel exceeds 50° C., it violently evaporates, thereby generating a lot of bubbles in the fuel supply system, resulting in obstruction of the correct control of air/fuel ratios, unstable rotation of the engine, and an increase in the emission of harmful gas components.

In normal operation of automobiles, the fuel supply system means such as the carburetor and other fuel supply passage means are provided with a cooling effect by the flow of intake air and the heat-absorbing evaporation of fuel. However, when the engine is brought to idling operation or stop subsequent to high-speed high-load operation, the fuel supply system is very liable to overheat. If the fuel existing in the fuel supply system is overheated, the viscosity of fuel greatly lowers and causes an unacceptable change of the flow coefficient of the jet means incorporated in the carburetor. Furthermore, the fuel existing in the float chamber and other passages of the carburetor boils and generates a lot of bubbles. These bubbles carry fuel droplets and take them into the air passage of the carburetor and so-called percolation occurs. If percolation occurs, the carburetor generates an over-rich fuel-air mixture which causes unstable operation of the engine, an increase of emission of uncombusted harmful components and poor restartability of the engine.

Furthermore, if the fuel bubbles are generated in the carburetor or other fuel supply passage means, they interrupt the flow of fuel therethrough and cause so-called vapor-locking. If vapor-locking occurs at any part of the fuel supply passage means, the supply of fuel is impeded and in the worst case the engine stops. Even when the engine does not stop, misfiring is caused. It is known that the above mentioned percolation or vapor-locking is caused principally by light components having low boiling points included in gasoline.

In order to avoid percolation or vapor-locking, it has been proposed, and practiced, to feed an excessive amount of fuel from the fuel tank to the carburetor by employing a fuel pump having a large excess capacity, so that a substantial flow of fuel is always maintained in the fuel pump and the fuel supply passage means in order to avoid any undesirable temperature rise of the fuel supply system. This system is generally called a fuel return system, and is effective for reducing the occurrence of percolation or vapor-locking. However, this system is not yet perfectly free from percolation or vapor-locking.

SUMMARY OF THE INVENTION

The object of the present invention is to provide an improved fuel supply system for engines in which the occurrence of percolation or vapor-locking is effectively avoided.

In accordance with the present invention, the above-mentioned object is accomplished by a fuel supply system for engines having a carburetor which has a float chamber and a vapor bleed passage connected to said chamber, comprising a fuel tank, a fuel supply passage means for supplying fuel from said fuel tank to the carburetor, and a fuel pump provided in said fuel supply passage means, said fuel supply passage means having a passage portion which traverses said float chamber. By this arrangement of the fuel supply system, the fuel contained in the float chamber is cooled by the fuel flowing through the fuel supply passage means. If the temperature of the fuel existing in the float chamber is high, the fuel flowing through said passage portion traversing the float chamber is heated up by absorbing heat from the fuel in the float chamber and enters into the float chamber as hot fuel. Upon entering into the float chamber, volatile components included in the fuel rapidly vaporize and are blown out of the float chamber through an air vent passage usually provided in the carburetor. As a result, medium and low volatile components remain in the chamber in the liquid state. Therefore, the liquid fuel contained in the float chamber has a higher boiling point and is less subject to percolation while it flows through the fuel passage incorporated in the carburetor. In this connection, it is more desirable that the passage portion of the fuel supply passage means which traverses the float chamber is located adjacent to an outlet port of the float chamber so as to apply an effective cooling action to the liquid fuel flowing out from the float chamber.

The fuel supply system for the present invention can operate more effectively when it is combined with the above-mentioned fuel return system. When combined with the fuel return system, the heat absorbed by the fuel flowing through the fuel supply system from the fuel contained in the float chamber is partly discharged toward the fuel tank by a part of the warmed-up fuel being returned to the fuel tank thereby applying a higher cooling effect to the fuel contained in the float chamber.

When the fuel supply system of the present invention is combined with the fuel return system, a vapor separating means may be incorporated at the branch portion where the return fuel passage is branched from the fuel supply passage. In this arrangement, even when the fuel flowing through the fuel supply passage has been so heated by the fuel contained in the float chamber that it begins to boil, the vapor generated by the boiling is separated by the vapor separating means and is returned to the fuel tank while the float chamber is principally supplied with medium and heavy components of the gasoline.

The passage portion of the fuel supply passage means which is arranged to traverse the float chamber should preferably be thermally insulated from the body of the carburetor. The passage portion which traverses the float chamber may be provided with fin elements for improving heat exchange at the passage portion. Or alternatively, the passage portion which traverses the float chamber may be formed as a helical pipe or a meander pipe.

BRIEF DESCRIPTION OF THE DRAWING

The present invention will become more fully understood from the detailed description given hereinbelow and the accompanying drawings which are given by way of illustration only and thus are not limitative of the present invention and wherein.

DESCRIPTION OF THE PREFERRED EMBODIMENT

Figure 1:
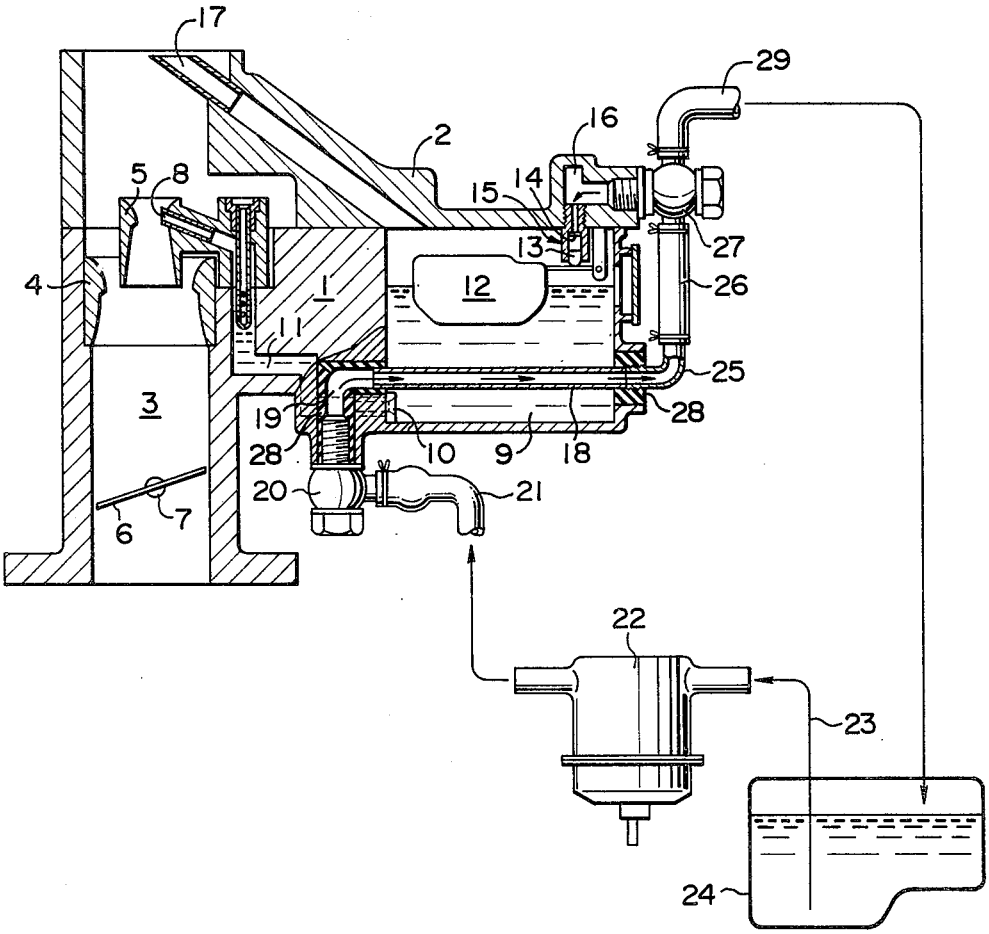
FIG. 1 is a partly diagrammatic view showing an embodiment of the fuel supply system for engines according to the present invention.

Referring to FIG. 1 showing a basic embodiment of the fuel supply system for engines according to the present invention, 1 designates the body of a carburetor and 2 designates an air horn mounted upon the body 1. The body 1 and the air horn 2 co-operate to provide an intake passage 3. A large venturi 4 is provided in the intake passage 3 and a small venturi 5 is provided in the throat area of the large venturi 4. At the downstream portion of the large venturi 4 in the intake passage 3 is provided a throttle valve 6 rotatably supported by a throttle valve shaft 7. A main nozzle 8 opens at the throat portion of the small venturi 5. The main nozzle 8 is supplied with gasoline from a float chamber 9 defined by the body 1 and the air horn 2 through a main jet 10 and a main fuel passage 11. The float chamber 9 is supplied with fuel through a needle valve means 15 having a needle valve element 13 adapted to be actuated by a float 12 and a needle seat 14 and a fuel supply passage 16 formed in the air horn 2 so as to be filled with fuel constantly up to a predetermined level. The fuel contained in the float chamber in the liquid state is drawn out through the main jet 10 and the fuel passage 11 towards the main port 8 while fuel vapor evaporated in the float chamber is drawn through an air vent 17 so as to be mixed into the intake air at the upstream of the venturi 4.

A conduit member 18 forming a part of the fuel supply passage means is provided in the float chamber 9 to traverse it, one end of the conduit member being connected to a fuel passage 19 formed in the body 1, said passage being connected in turn with a union connecting element 20 which is connected with the delivery port of a fuel pump 22 by a fuel pipe 21. the inlet port of the fuel pump 22 is connected with a fuel take-out pipe 23 having one end located close to the bottom of a fuel tank 24. The other end of the conduit means 18 is connected with a bent element 25 which is connected with a union connecting element 27 by a pipe element 26. The union connecting element 27 is connected with the fuel supply passage 16. As shown in the figure, it is desirable that the conduit means 18 is arranged to traverse a bottom portion of the internal space of the float chamber 9. Furthermore, it is desirable that the passage portion formed to traverse the body 1 is thermally insulated from the body by insulating elements such as designated by 28.

In the shown embodiment, the union connecting element 27 mounted at the inlet portion of the fuel supply passage 16 has a connection for a fuel return pipe 29 which is adapted to return excess fuel supplied from the fuel supply passage means including the fuel pump 22 to the fuel tank 24.

In operation, the fuel contained in the fuel tank 24 is drawn up by the fuel pump 22 through the pipe 23 and is delivered through the pipe 21, union connecting element 20, passage 19, and conduit means 18. While the fuel flows through the conduit means 18, it is in heat exchange relationship with the fuel contained in the float chamber 9 and, if the fuel contained in the float chamber is in a hot condition, it gives heat to the fuel flowing through the conduit means 18 which is then heated up while it gives a cooling effect to the fuel contained in the float chamber. The fuel thus heated while flowing through the conduit means 18 is further led through the bent element 25, pipe 26, and union connecting element 27, wherefrom a part of the fuel flows through the passage 16 and the needle valve 15 to be supplied into the float chamber 9, while the remaining part of the fuel is returned to the fuel tank through the return passage 29. Upon entering into the float chamber, the more volatile components included in the hot gasoline rapidly evaporate and the vapors are drawn out through the air vent 17 while medium and heavy components remain in the float chamber in the liquid state thereby making the fluid contained in the float chamber less volatile when compared with the gasoline supplied to the float chamber by the conventional fuel supply system.

Figure 2:
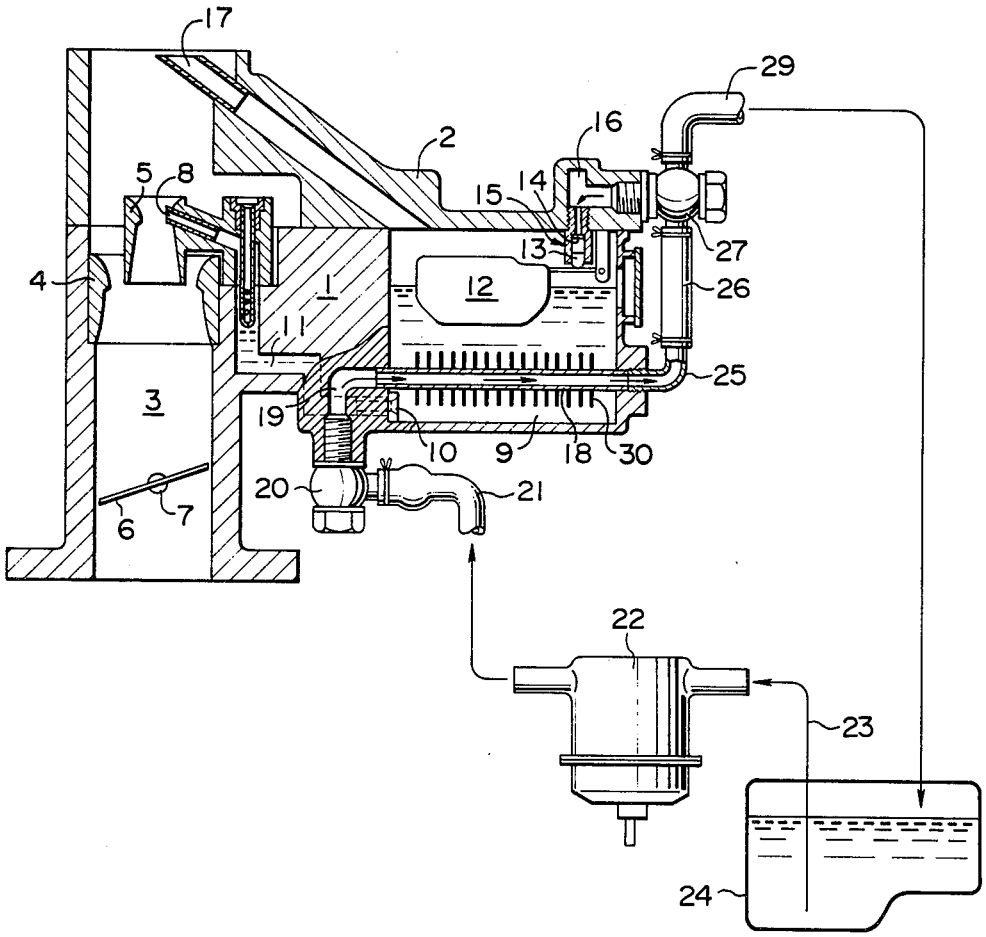
FIGS. 2 and 3 are views similar to FIG. 1 showing two modifications of the embodiment shown in FIG. 1.
Figure 3:
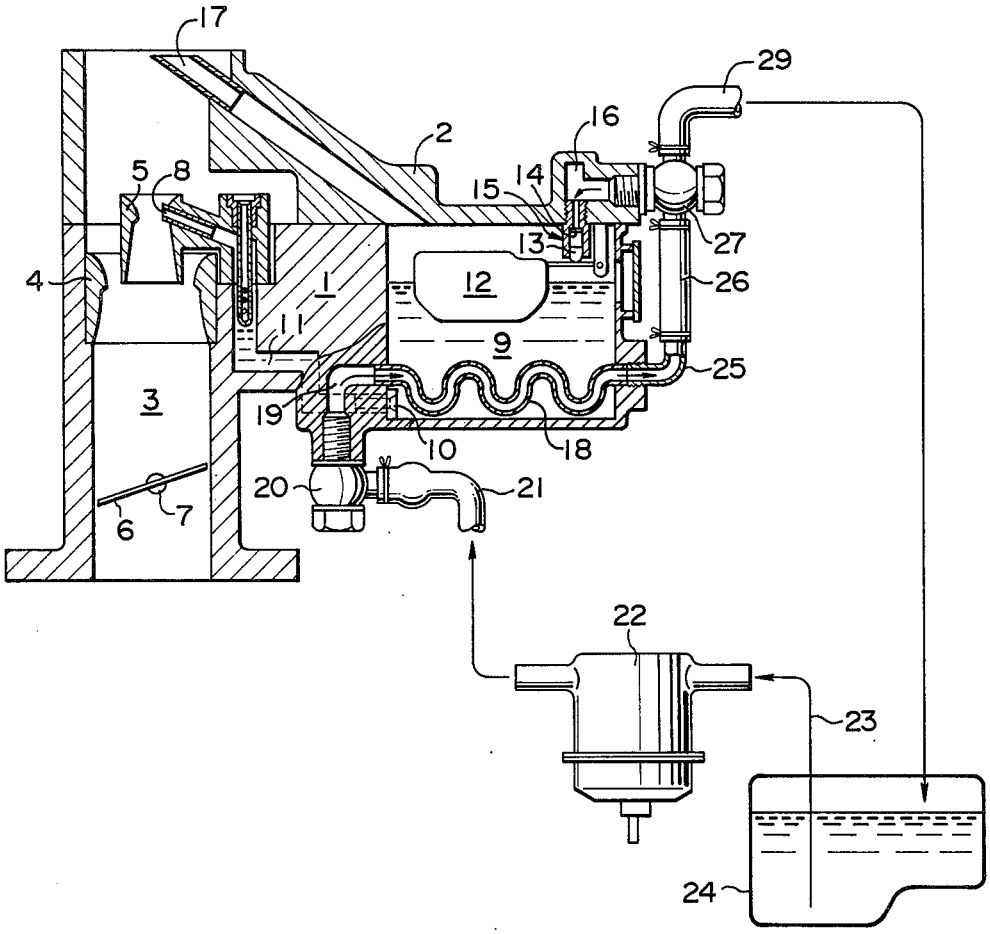

FIGS. 2 and 3 show some modifications of the fuel supply system shown in FIG. 1. In FIGS. 2 and 3, the portions corresponding to those shown in FIG. 1 are designated by the same reference numerals. In the modification shown in FIG. 2, the conduit means 18 has a number of fins 30 provided therearound for the purpose of enhancing the heat exchange between the fuel flowing through the conduit means 18 and the fuel contained in the float chamber.

In the modification shown in FIG. 3, the conduit means 18 is formed as a meander pipe for the same purpose of enhancing the heat exchange between the fluid existing inside and outside the conduit means 18.

Furthermore, in the embodiment shown in FIGS. 2 and 3, the fuel passage 19, the union connecting element 20 and the bent pipe element 25 are not thermally insulated from the body 1 of the carburetor. In this case, therefore, the body of the carburetor is also given a cooling effect by the fuel flowing through the fuel supply passage.

Figure 4:
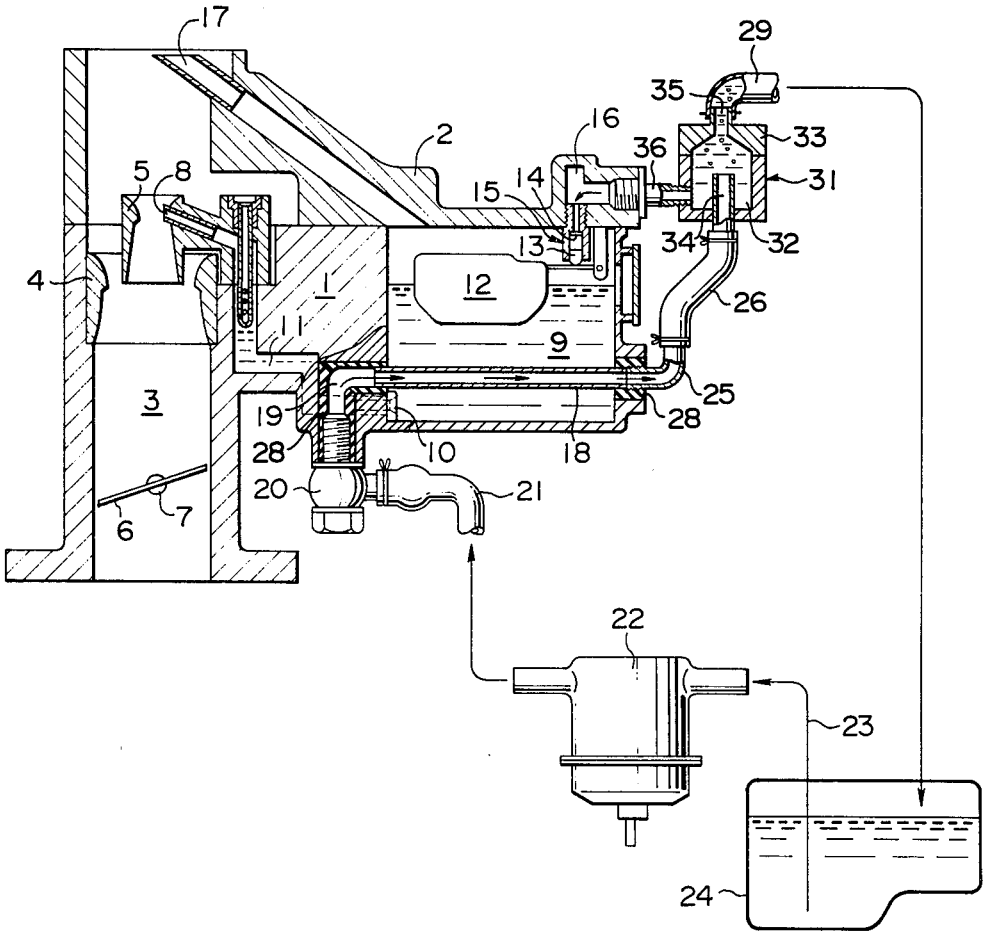
FIG. 4 is a view similar to FIG. 1 showing still another embodiment of the present invention.

FIG. 4 shows still another embodiment of the fuel supply system of the present invention. Also in FIG. 4, the portions corresponding to those shown in FIG. 1 are designated by the same reference numerals. In this embodiment, the union connecting element 27 in FIG. 1 is replaced by a vapor separating means 31 which also serves as a connecting means for the pipe 26, the fuel supply passage 16 and the return pipe 29. The vapor separating means 31 has a casing 33 defining a separating chamber 32. The fuel inlet port for the separating chamber 32 is provided by a tubular member connected with the pipe 26 and projecting into the separating chamber 32. Opposing the projecting inlet port 34 is provided a fuel return port 35 connected with the return pipe 29. A bottom portion of the separating chamber 32 is connected with the fuel supply passage 16 of the carburetor by a nipple connecting element 36.

In this embodiment the vapors generated in the fuel flowing through the fuel supply passage due to heat absorption from the fuel contained in the float chamber are provisionally separated from the liquid fuel in the vapor separating means 31 and are directly returned to the tank through the return pipe 29, whereby the fuel entering into the float chamber under a hot carburetor condition is made beforehand less volatile thereby more effectively avoiding the generation of percolation or vapor-locking in such a hot carburetor condition.

Although the invention has been shown and described with respect to some preferred embodiments thereof, it should be understood by those skilled in the art that various changes and omissions of the form and detail thereof may be made therein without departing from the scope of the invention.

We claim:

1. A fuel supply system for an internal combustion engine, comprising:

a carburetor having a float chamber and a vapor bleed passage connected to said float chamber;

a fuel tank;

a fuel pump;

a fuel supply passage means which conducts fuel from said fuel tank into said float chamber so as to maintain the lever of fuel therein through said fuel pump, and which includes at a middle portion thereof a passage portion which passes through said float chamber without direct communication from the passage portion to the float chamber.

2. The system of claim 1, further comprising a fuel return passage means connected to said fuel supply passage means downstream of said passage portion and adapted to return the excess fuel supplied through said fuel supply passage means to said fuel tank.

3. The system of claim 1, wherein said fuel supply passage means including said passage portion is thermally isolated from the body of the carburetor.

4. The system of claim 1, wherein said passage portion is at least partially a finned tube.

5. The system of claim 1, wherein said passage portion is a meander tube.

6. The fuel supply system of claim 2, wherein the connecting point of said fuel return passage to said fuel supply passage is formed so that said fuel return passage rises vertically upward from said connecting point while said fuel supply passage turns horizontally sidewards at said connecting point, so that the lighter elements of hot fuel passing through said fuel supply passage to the connecting point have a greater tendency to enter said fuel return passage than do the heavier elements of the hot fuel.

7. The fuel supply system of claim 2, wherein the connecting point of said fuel return passage to said fuel supply passage is formed as a vapor separating means which comprises a separating chamber for fuel which is formed with an inlet, a first outlet towards said fuel return passage at a higher level than said inlet, and a second outlet towards said float chamber at a lower lever than said inlet.

* * * * *